US005253485A

United States Patent [19]

Kennedy et al.

[11] Patent Number: 5,253,485

[45] Date of Patent: Oct. 19, 1993

[54] LOW PROFILE ROOM AIR CONDITIONER

[75] Inventors: Robert W. Kennedy, Dublin, Ohio; Richard F. Stewart, North Brunswick, N.J.

[73] Assignee: White Consolidated Industries, Inc., Cleveland, Ohio

[21] Appl. No.: 859,161

[22] Filed: Mar. 27, 1992

[51] Int. Cl.[5] ..... F25D 23/12

[52] U.S. Cl. ..... 62/262; 62/419; 454/201; 454/204; 454/214; 454/215

[58] Field of Search ..... 62/262, 419; 454/201, 454/204, 214, 215; D23/354

[56] References Cited

U.S. PATENT DOCUMENTS

| | | | |
|---|---|---|---|
| 2,198,500 | 12/1938 | Jowell . | |
| 2,316,640 | 4/1943 | Williams | 454/204 |
| 2,391,859 | 11/1931 | Babcock . | |
| 2,682,159 | 6/1954 | Trask . | |
| 2,717,139 | 9/1955 | Jewell | 454/204 X |
| 2,737,788 | 3/1956 | Buttner . | |
| 2,789,494 | 4/1957 | Goettl et al. | 454/204 X |
| 2,826,048 | 3/1958 | Wheeler | 62/262 |
| 2,998,711 | 9/1961 | Komroff | 454/204 X |
| 3,416,329 | 12/1968 | Thomas | 62/262 |
| 3,448,590 | 6/1969 | Eberhart . | |
| 3,543,533 | 12/1970 | Oberdier . | |
| 3,548,611 | 12/1970 | Ulich . | |
| 3,552,139 | 1/1971 | Ulich . | |
| 3,602,006 | 8/1971 | Metcalfe et al. . | |
| 3,838,579 | 10/1974 | Ballard | 62/262 |
| 3,911,803 | 10/1975 | Kong et al. | 62/262 X |
| 4,633,680 | 1/1987 | Lang et al. | 62/262 X |
| 4,667,483 | 5/1987 | Hashimoto | 62/262 |
| 5,081,849 | 1/1992 | Thompson et al. | 62/262 |
| 5,085,057 | 2/1992 | Thompson et al. | 62/262 |

FOREIGN PATENT DOCUMENTS

| | | | |
|---|---|---|---|
| 1401834 | 7/1975 | United Kingdom | 62/262 |

*Primary Examiner*—Henry A. Bennet
*Assistant Examiner*—Christopher Kilner
*Attorney, Agent, or Firm*—Pearne, Gordon, McCoy & Granger

[57] ABSTRACT

A room air conditioner for mounting in a window opening having a vertically sliding lower sash. The enclosure for the unit has front and rear portions separated by the vertical plane of the window opening, the compressor and condenser heat exchanger being mounted in the rear portion, and the evaporator heat exchanger being mounted in the front portion. A motor that is connected to an axial flow fan at one end and a coaxial centrifugal blower wheel at the other end is also located in the rear portion. The axial flow fan is operatively associated with the condenser heat exchanger and the centrifugal blower wheel is operatively associated with the evaporator heat exchanger. The forward enclosure portion and the evaporator heat exchanger extend above the bottom of the bottom rail of the lower sash, and the rear housing portion and the condenser heat exchanger extend above the bottom rail of the lower sash and substantially below the level of the window sill. The enclosure is provided with a leveling means to adjust the level of the unit during mounting on the window sill.

10 Claims, 8 Drawing Sheets

LOW PROFILE ROOM AIR CONDITIONER

BACKGROUND OF THE INVENTION

This invention relates to air conditioning equipment suitable for residential use, and especially to room air conditioners of the type adapted for installation in an outside window opening. More particularly, the invention relates to the construction of a room air conditioner that minimizes the obstruction it causes to the view and to entry of natural daylight through the window in which it is mounted while at the same time having a relatively small intrusion into the interior space.

Room air conditioners currently available are generally designed for mounting on the window sill of a window frame with double-hung sash-type windows. The air conditioning unit is generally mounted in cantilever fashion in the window opening defined by the window sill, the bottom rail of the lower sash (partly opened), and the adjacent window jambs.

In most of these units, the height of the air conditioner is considerable and the unit may obstruct as much as thirty percent or more of the window area. This, of course, causes a substantial loss of natural daylight and also interferes with the view provided by the window. Several attempts have been made to reduce this problem, and some of these have included separating the evaporator heat exchanger and fan physically from the condenser heat exchanger and fan. This approach results in a rather complex and cumbersome unit, with certain inefficiencies including the need for two separate motors for the respective heat exchanger fans.

Another approach is to include a downwardly extending enclosure portion located on the outside of the window so that the compressor and motor, condenser heat exchanger and fan can be positioned so as to extend significantly below the horizontal level of the window sill. While this may provide a partial solution, the need to provide adequate space for the evaporator heat exchanger still requires a substantial blockage of the window area.

Typical of the patents that have addressed this problem are the following:

| | |
|---|---|
| 2,198,500 | 3,543,533 |
| 2,391,859 | 3,548,611 |
| 2,682,159 | 3,552,139 |
| 2,737,788 | 3,602,006 |
| 3,448,590 | |

Another problem that presents itself in the installation of room air conditioners is the difficulty in mounting the unit in a level position in view of the slope formed by the surface of the sill.

While the sill may be sufficiently wide to define mounting structure and to accommodate a significant part of the weight of the unit, the slope that is provided for moisture run-off makes it difficult to achieve a level mounting.

The low profile room air conditioner of the present invention reduces the difficulties and disadvantages described above and affords other features and advantages heretofore not obtainable.

SUMMARY OF THE INVENTION

It is among the objects of the present invention to provide a room air conditioner adapted for mounting in an outside window with a vertically sliding sash, that requires a minimum vertical projection or intrusion into the window area.

Another object of the invention is to improve the aesthetic appearance and character of a room air conditioner, in part, by minimizing the obstruction to natural light that can be obtained through the window opening.

A further object of the invention is to provide an improved means for mounting a room air conditioner in a level position on a window sill with a sloping upper surface provided for moisture drainage.

These and other objects and advantages are achieved with the unique room air conditioner design of the present invention, the unit being of the type adapted to be mounted in a window opening having a vertically sliding lower sash. The opening in most instances is defined by the window sill, the bottom rail of the lower sash, and the opposed jambs.

In accordance with the invention, the air conditioner has an enclosure with front and rear portions separated by the vertical plane of the window opening. A compressor and a condenser heat exchanger are mounted in the rear portion and an evaporator heat exchanger is mounted in the front portion. A motor that is drivingly connected to an axial flow fan at one end and a coaxial centrifugal blower wheel at the other end is located in the rear portion. The axial flow fan is operatively associated with the condenser heat exchanger and the centrifugal blower wheel is operatively associated with the evaporator heat exchanger.

The forward enclosure portion and the evaporator heat exchanger extend above the bottom of the bottom rail of the lower sash. The rear housing portion and the condenser heat exchanger extend above the bottom of the bottom rail of the lower sash and substantially below the level of the window sill.

As another aspect of the invention, the enclosure is provided with means engageable with the sloping surface of the window sill to enable the unit to be adjusted to a level condition while supported at least in part by the sill.

DESCRIPTION OF THE PREFERRED EMBODIMENT

Figure 1:
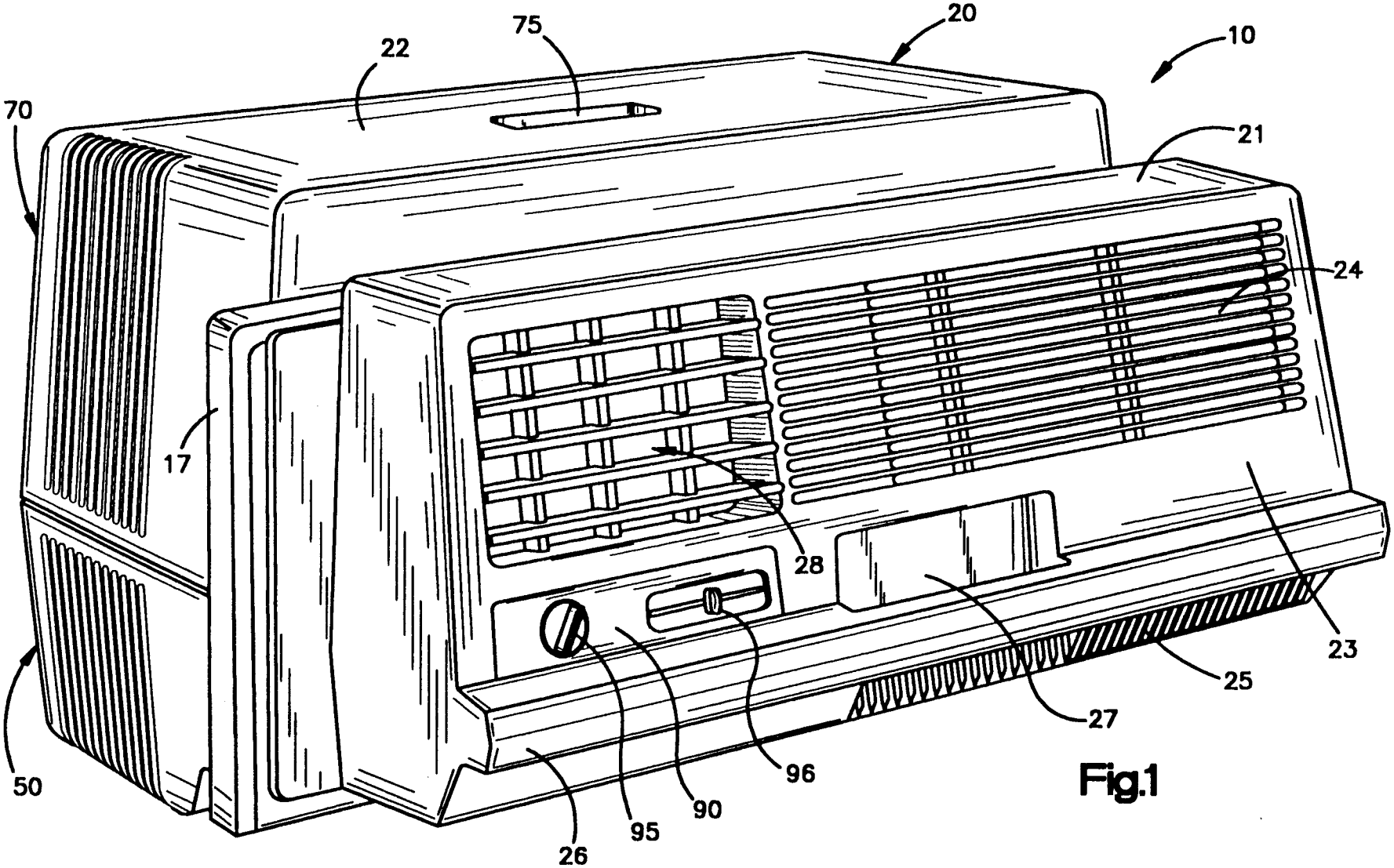
FIG. 1 is a perspective view of a low profile room air conditioner embodying the present invention and illustrating an unmounted condition.
Figure 5:
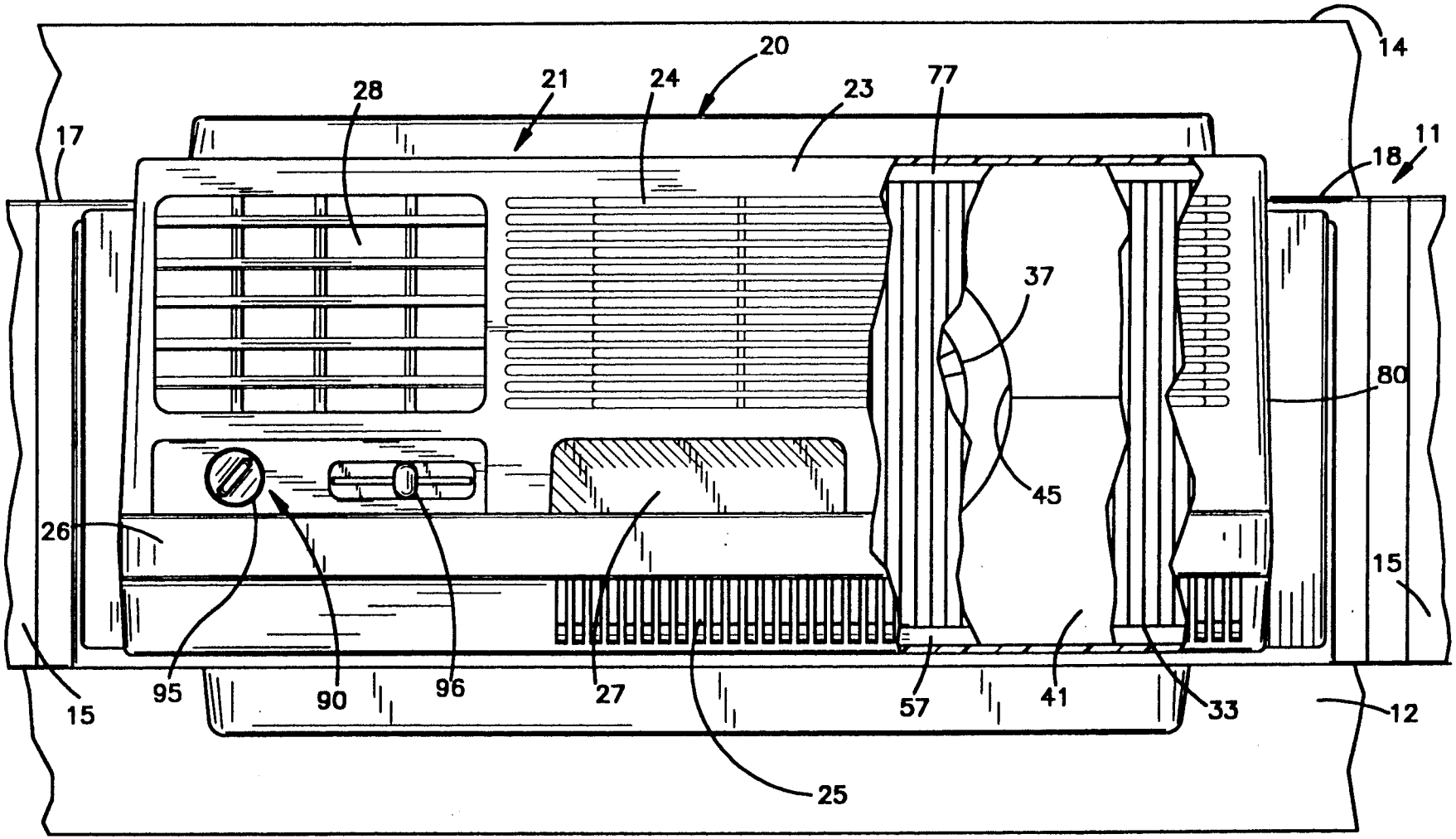
FIG. 5 is a front elevation of the low profile room air conditioner of FIGS. 1 and 4, showing the unit mounted in an opening in a window with a vertically sliding lower sash.
Figure 6:
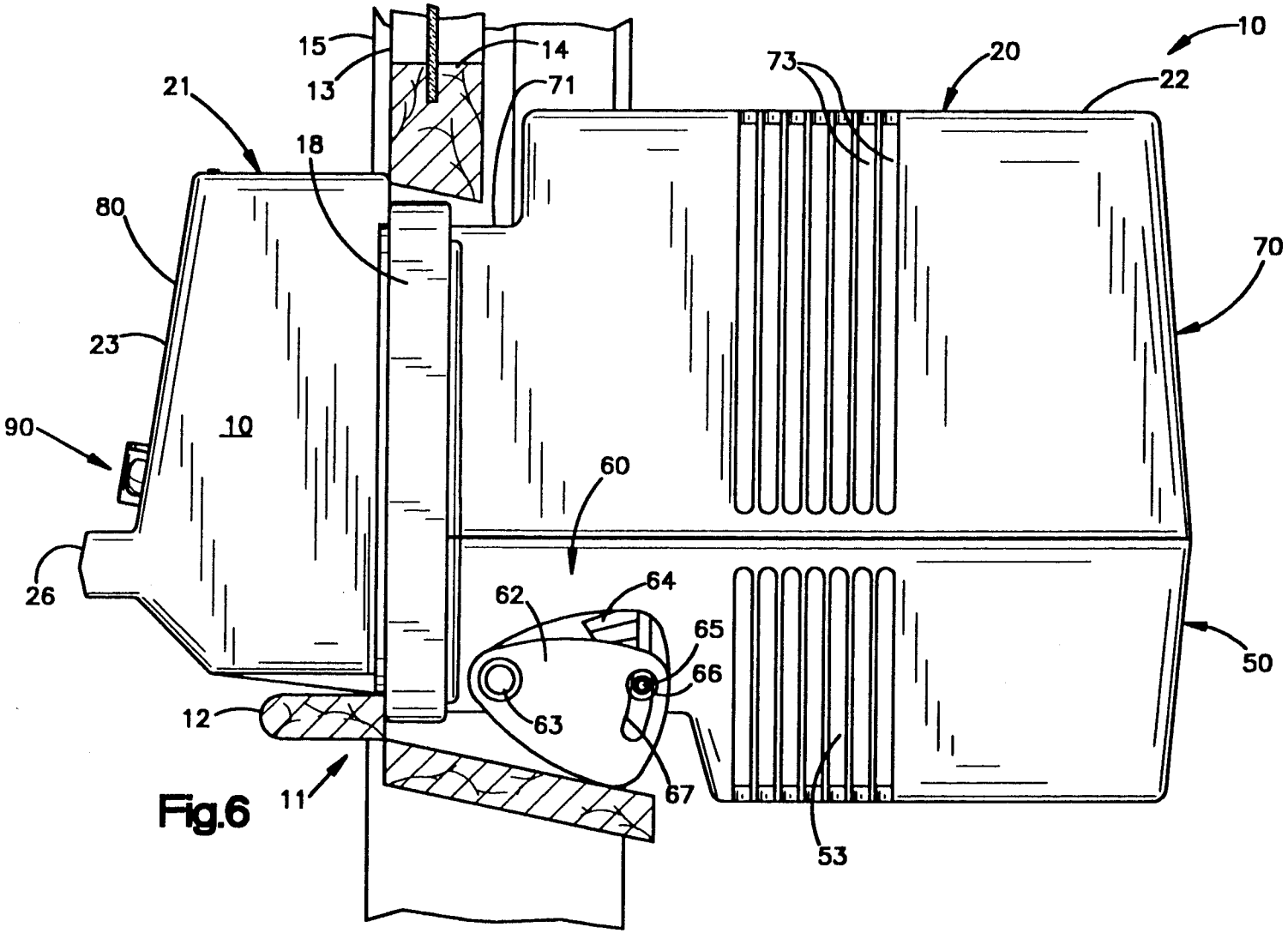
FIG. 6 is a side elevation of the low profile room air conditioner of FIGS. 1, 4, and 5, showing the unit mounted in a window opening (shown in section) and with parts broken away for the purpose of illustration.
Figure 7:
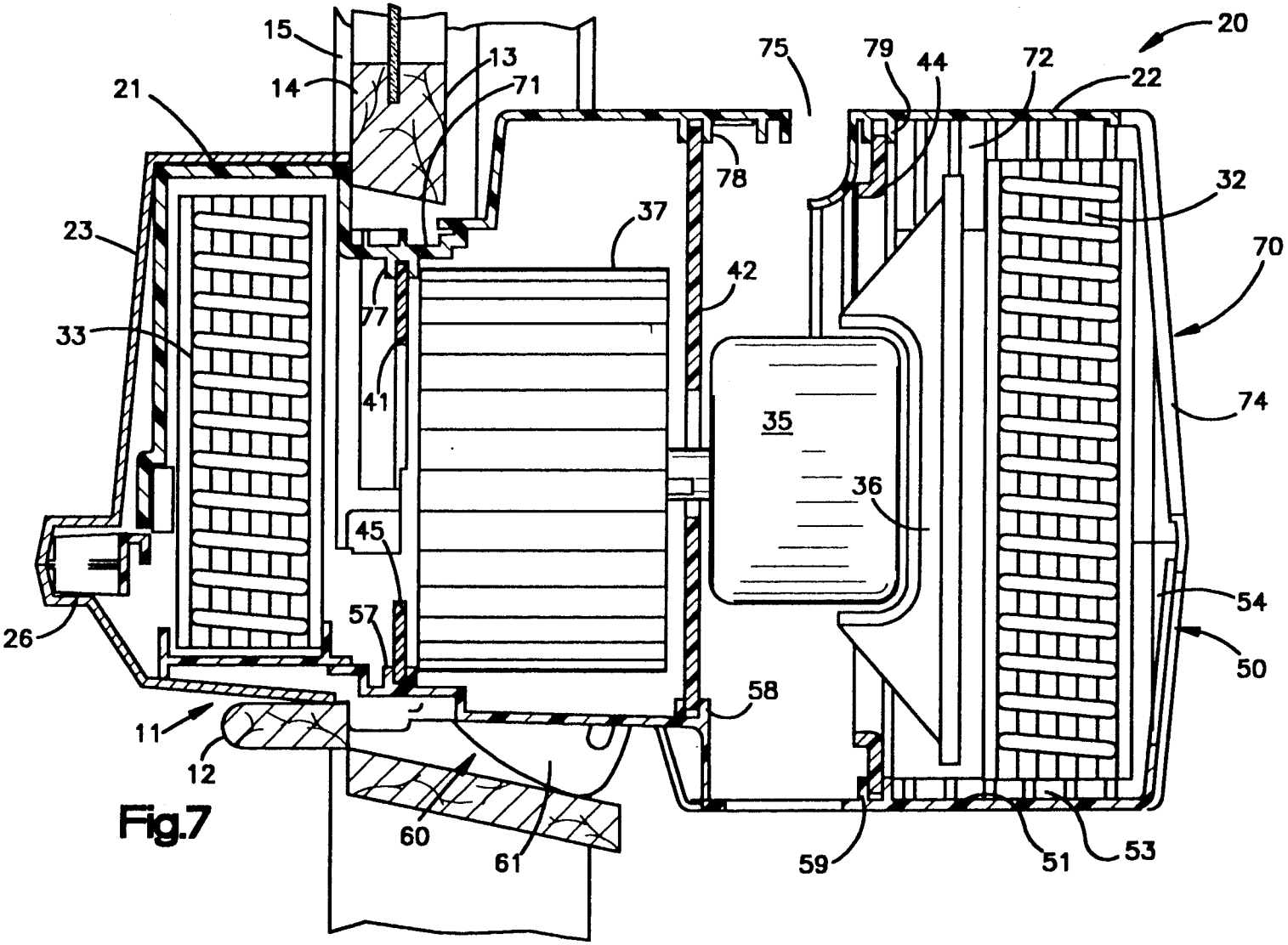
FIG. 7 is a sectional view taken on the line 7—7 of FIG. 4 but showing the internal components in elevation.

Referring more particularly to the drawings, FIG. 1 illustrates the overall exterior appearance of a preferred embodiment of room air conditioner embodying the invention. The illustrated unit 10 is adapted to be mounted in a window opening 11, such as illustrated in FIGS. 5 through 7. The particular window illustrated is the type having a vertically sliding lower sash 13. The opening is defined by a horizontal sill 12, the lower sash 13 with a horizontal sash rail 14, and side jambs 15. In actual use, the unit 10 would not be as wide as the space between the jambs 15 and the adjacent spaces would be closed by some means such as the accordion-type panels 17 and 18 that are extendible laterally from the room air conditioner 10.

Referring to FIG. 6, the room air conditioner includes an enclosure 20 formed by a pair of molded housing sections 50.70, that are adapted to fit together and be secured to one another. Along with a number of internal partitions, they define the various chambers and passages required and provide support for the operating components of the air conditioning system. The enclosure 20 includes a lower housing section 50, an upper housing section 70 and a front housing section 80 that, in assembled condition, define a forward enclosure portion 21 that extends into the room to be served by the unit, and an enlarged rearward enclosure portion 22 that is located outwardly of the window and is generally separated from the forward portion 21 by the vertical plane of the window opening 11.

Located at the front face of the forward portion 21 is a grille 23 with an upper air inlet 24 and a lower inlet portion 25 formed in the front housing section 80. The forward housing portion 21 also has a forward extension or bar 26 and, formed therewith, and a handle recess 27 that facilitates carrying and installation of the unit.

Referring to FIG. 5, a control module 90 is located in the front housing portion 80 and is adapted to contain the electrical control components and a control panel as will be described in detail below. Located at the left-hand side of the grille 23 is an air outlet 28.

Figure 2:
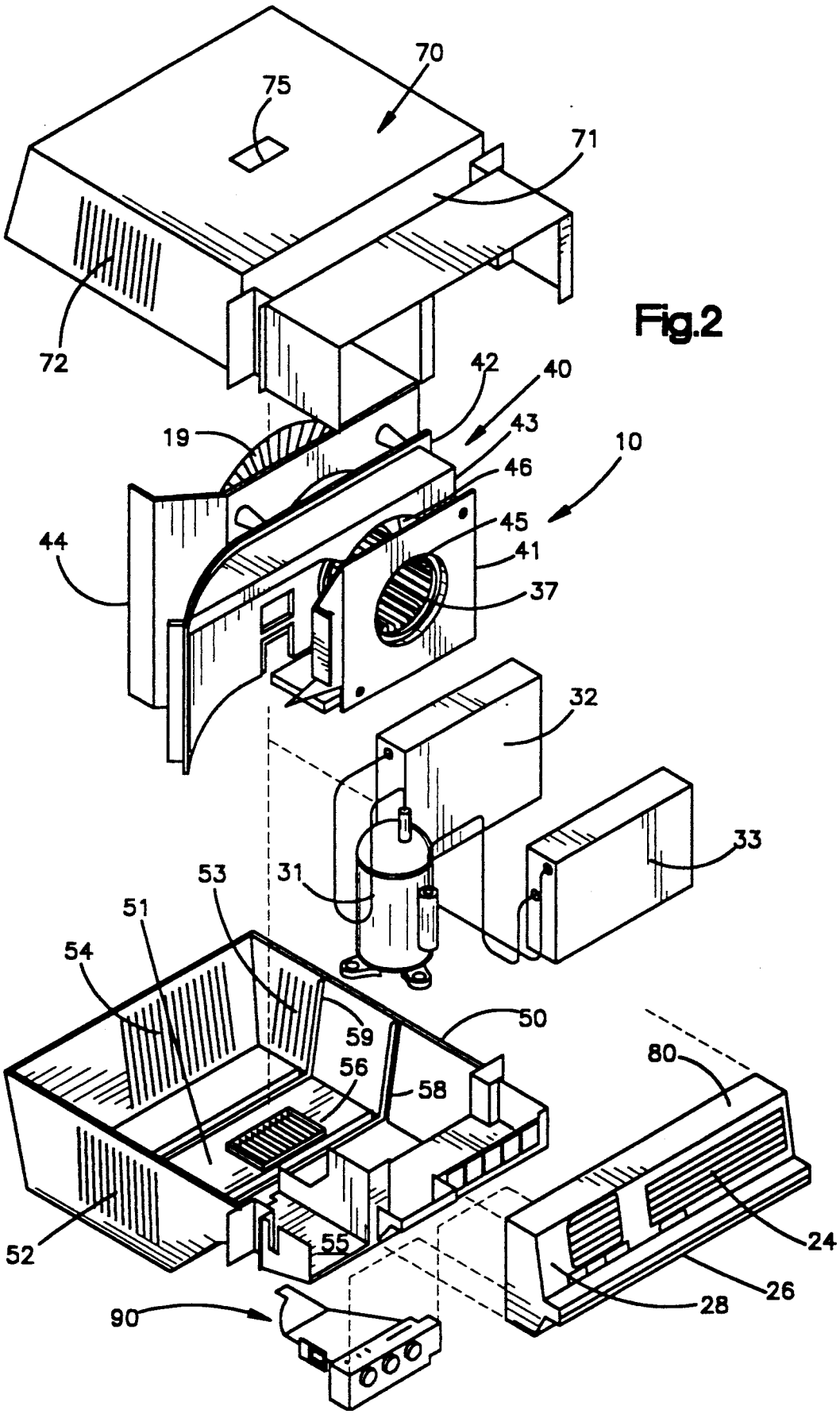
FIG. 2 is an exploded perspective view of the low profile room air conditioner of FIG. 1.

Referring to FIGS. 2 and 7, located in the enlarged rearward enclosure portion 22 and supported by the lower housing section 50 are the compressor 31 and the condenser heat exchanger 32. An evaporator heat exchanger 33 is supported vertically in the forward housing portion 21 immediately behind the grille 23.

Figure 3:
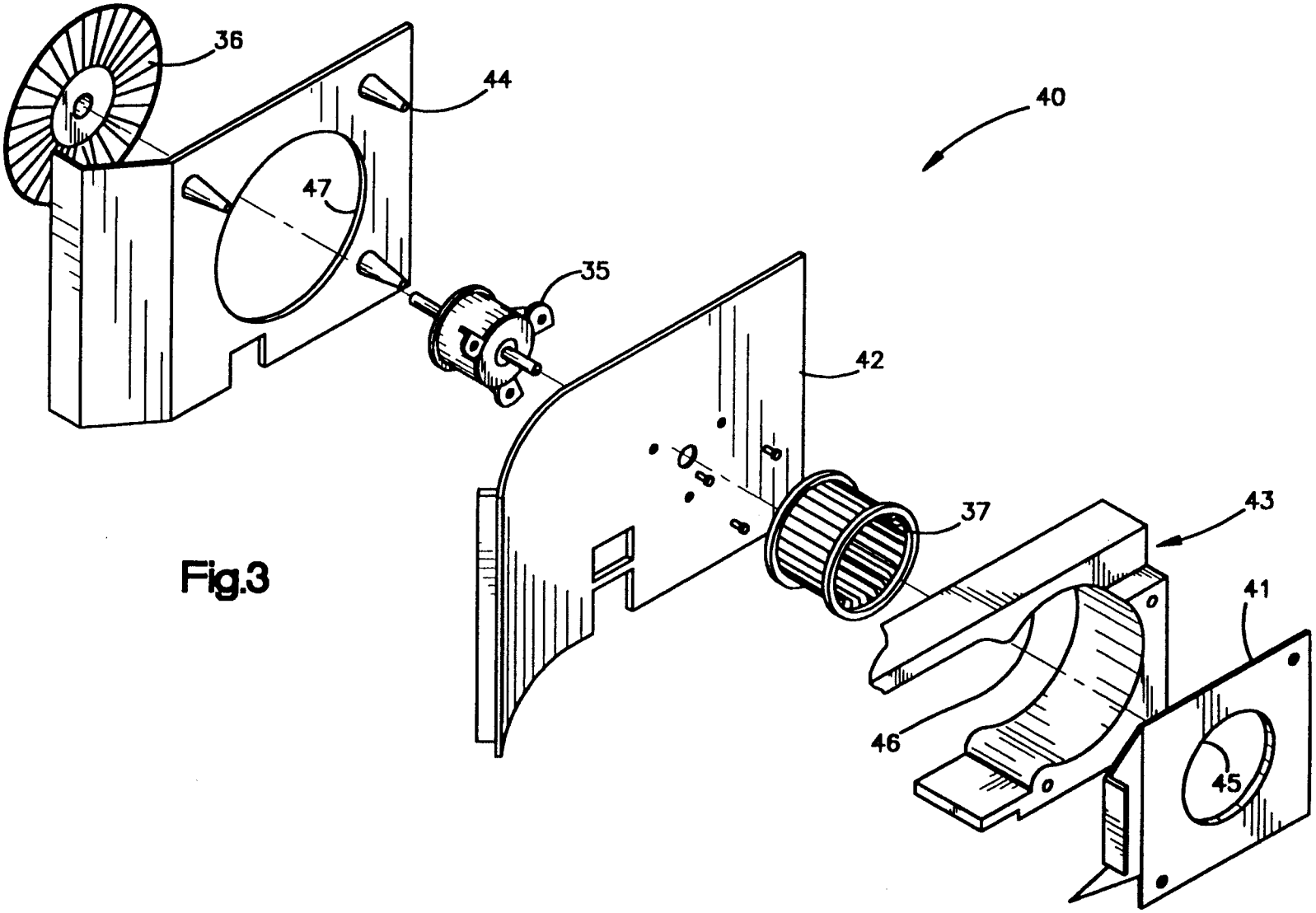
FIG. 3 is an exploded perspective view of the air handling module comprising one of the components shown in exploded relation in FIG. 2.

A motor 35 is mounted in the rearward enclosure portion 22, as indicated in FIGS. 3 and 7. The motor drives an axial-flow fan 36 located in operative association with the condenser heat exchanger 32. Mounted at the opposite side of the motor 35 is a centrifugal blower wheel 37 that is operatively associated with the evaporator heat exchanger 33.

Also located in the rearward enclosure portion 22 is an air handling module 40 shown in exploded form in FIG. 3. The module 40 cooperates with the axial flow blower fan 36 and the centrifugal blower wheel 37 to control the flow of inside air through the evaporator heat exchanger 33 and out through the air outlet 28. Also, it controls the flow of outside air into the rearward enclosure portion 22, through the condensor heat exchanger 32 and then through exhaust means.

The air handling module 40 includes a scroll face partition 41, a bulkhead partition 42, a scroll section 43, and a condenser fan shroud partition 44. The scroll face partition 41 defines a circular opening 45 that provides an air inlet for the centrifugal blower wheel 37. It will be seen that this opening 45 is located at the constricted portion of the enclosure 20 that separates the forward enclosure portion from the enlarged rearward enclosure portion 22. The scroll section 43 defines with the adjacent partitions 41 and 42, an involute shaped flow passage 46.

The bulkhead partition 42 has a small circular opening that permits the shaft of the motor 35 to extend through to the centrifugal blower wheel 37. The condenser fan shroud partition 44 has a large circular opening 47 formed therein to provide an inlet for the axial flow fan 36.

Figure 4:
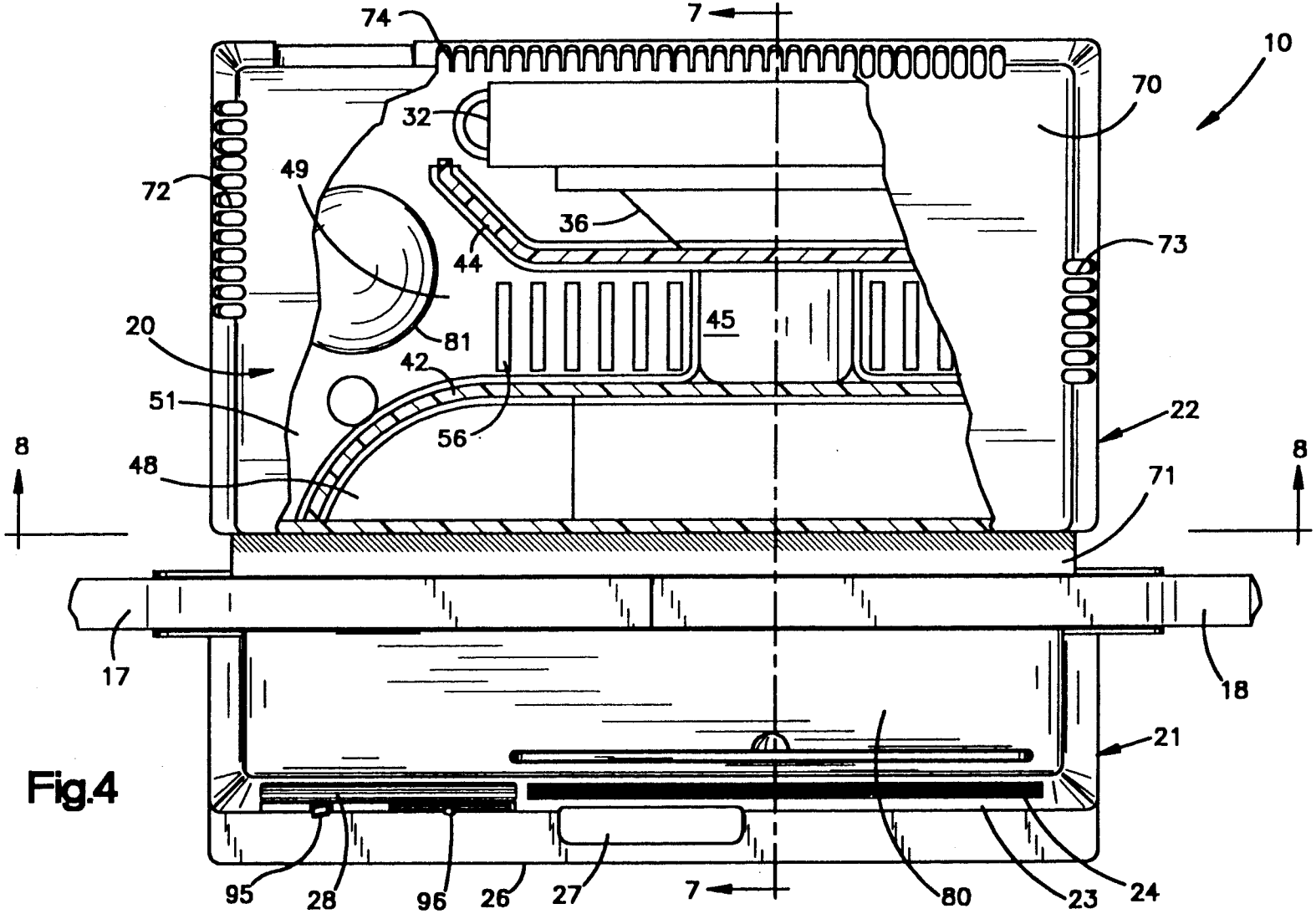
FIG. 4 is a plan view of the low profile room air conditioner of FIG. 1, with parts broken away for the purpose of illustration.

As viewed in FIGS. 2, 3 and 4, the bulkhead partition 42 curves forwardly at the left hand side to divert the flow of air from the centrifugal blower wheel 37 and to direct it through the air outlet 28 formed in the forward enclosure portion 21. Also, the condenser fan shroud partition 44 curves outwardly at its rearward end to define the flow path for inlet air flowing into the enlarged rearward enclosure portion and being drawn into the axial flow blower fan 36.

Thus, the air handling module 40 serves to divide the interior of the enclosure 20 into an evaporator flow chamber 48 and a condenser flow chamber 49.

The lower housing section 50 has a horizontal floor 51 which, as indicated in FIG. 7, is located in a plane substantially below the horizontal level of the window sill 12. This permits a substantial portion of the space defined by the enlarged rearward portion of the enclosure to be located below the window opening 11 to minimize interference with the admission of light to the room and also to provide minimum obstruction of the view through the window.

The operating components referred to above are mounted in conventional fashion to the floor 51 of the lower housing section 50.

Formed on the opposite sidewalls of the lower housing section 50 are two groups of vertical slots 52 and 53, respectively. Also, in the horizontal floor 51 of the lower housing section 50 is a group of slots 56, as shown in FIG. 2. Together, these three groups of slots provide air inlets for the axial flow fan 36. Also on the rearward wall of the lower housing section 50 are another group of vertical slots 54 that provide part of the outlet for air flowing through the condenser heat exchanger 32 and being exhausted into the surrounding atmosphere.

The motor 35 (FIG. 3) is supported on the bulkhead partition 42 at three points.

A horizontal floor panel 55 is mounted on the left-hand side of the forward enclosure portion adjacent the floor 51 of the lower housing section to assist in directing the flow of conditioned air out through the air outlet 28.

Referring to FIGS. 2 and 7, the lower housing section 50 has three sets of tracks extending laterally from side to side parallel to the plane of the window opening 11. These include a forward track 57, a middle track 58, and a rearward track 59. These tracks serve to locate and support the vertical partitions 41, 42 and 44 described below.

In accordance with one aspect of the invention, the enclosure is provided with a pair of leveling assemblies 60 located on opposite sides of the lower housing section 50 and which serve to facilitate the positioning of the room air conditioner 10 in a level or horizontal position. This is often difficult, due to the outward slope that is typical on the sill portion 12 of most windows as illustrated in a typical situation in FIG. 6.

The leveling assemblies 60 include leveling arms 61 and 62, one of which is located on each side of the housing and mounted on the lower housing section 50. The two leveling assemblies 60 are identical, and will be described with respect to the leveling arm 62 on the right-hand side of the air conditioner as viewed in FIG. 6.

The arm 62 is connected at its forward end by a pivot pin 63 to the sidewall of the lower housing section 50. The pivotal connection permits free pivotal movement of the arm to a plurality of positions as required. The adjacent outer surface of the sidewall of the lower housing section is provided with a pattern of radial teeth, the radial pattern being defined by the axis of the pivot pin 63. Also, an opening 65 is formed through the lower housing section wall and is adapted to receive a clamping bolt 66 which extends therethrough.

The outer end of the clamping bolt 66 extends through an arcuate slot 67 formed at the outer portion of the leveling arm 62. The inner surface of the leveling arm 62 is provided with a pattern of radial teeth (68, not shown) adapted to engage and mesh with the radial teeth 64 formed on the housing surface.

Accordingly, during installation, the air conditioner may be placed in a desired horizontal position and the clamping bolts 66 loosened to permit the arms 61 and 62 to pivot downwardly into engagement with the sloping surface of the sill 12. This determines the correct supporting position of the leveling arms 61 and 62. Then the clamping bolt may be turned to thread it into a fixed nut positioned on the interior surface of the housing wall. This forces the radial teeth 64 and 68, respectively, into tight engagement to secure the leveling arms 61 and 62 in their desired mounting positions.

Thus, the leveling assembly 60 of the invention affords a convenient and efficient means for providing support for the air conditioner relative to a sloping sill surface. Also, the leveling arms 62, once they are securely clamped in position, provide convenient supports for sliding the room air conditioner 10 into and out of position in the window opening 11. This is particularly convenient when the unit needs to be removed for repair or replacement of parts, or when the window assembly needs to be serviced or repaired. It will be noted that the leveling arms 61 and 62 have curved corners so as to facilitate the sliding movement across the window sill.

Figure 8:
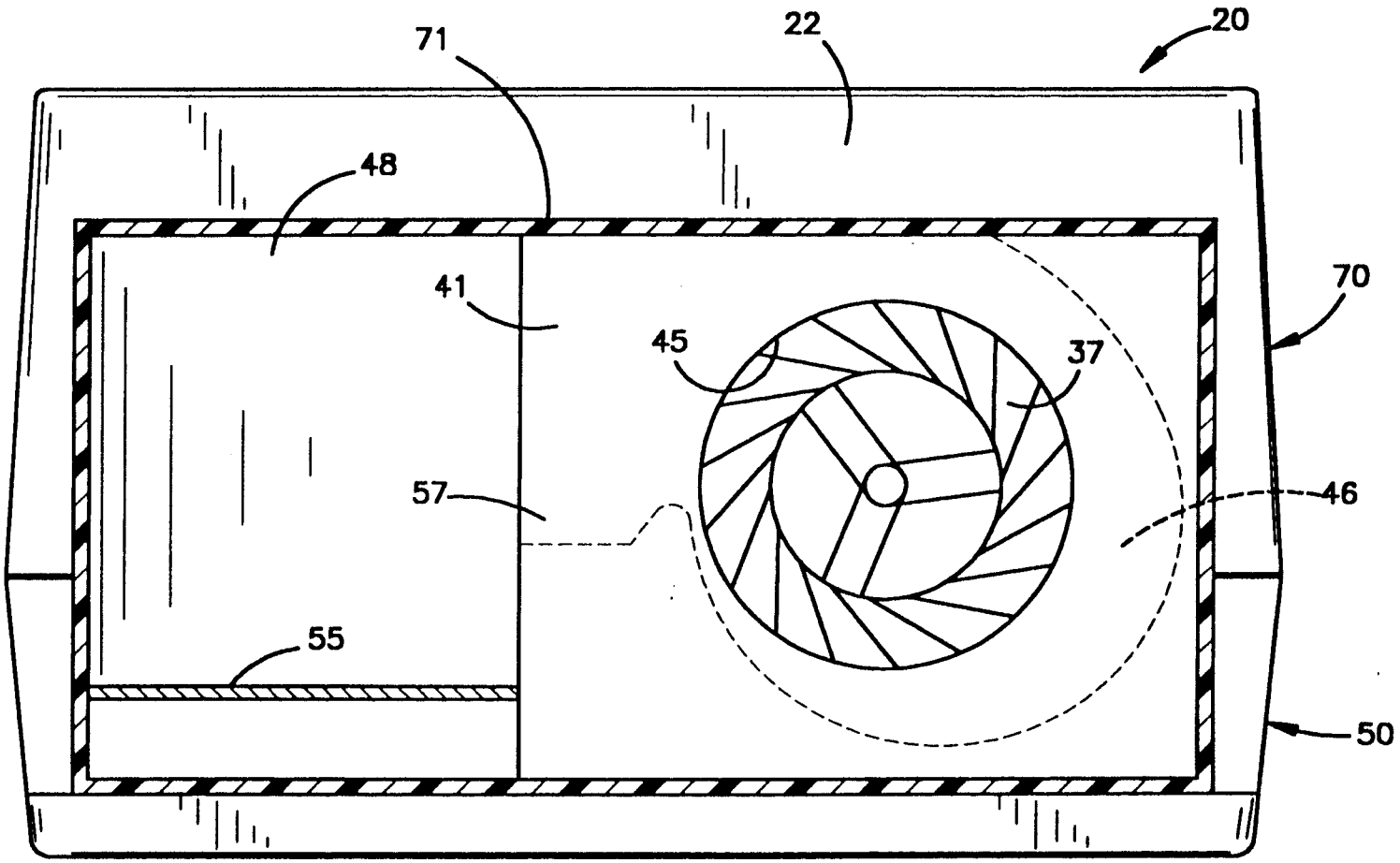
FIG. 8 is a sectional view taken on the line 8—8 of FIG. 4.

The upper housing section 70 defines a lateral channel 71 adapted to receive the lower rail 14 of the window sash 13 to facilitate sealing of the air conditioning unit 10 in the window opening As best viewed in FIG. 6, the enlarged rearward portion 22 of the enclosure 10 extends both upwardly approximately the height of the sash rail 14 and downwardly below the level of the window sill 12 so that the vertical height of the enlarged rearward portion 22 is substantially greater than the height of the window opening 11. More particularly, with the design of the invention, the height of the enlarged rearward portion 22 is 25% or more greater than the height of the window opening, as shown in FIG. 8, wherein the hatched-line section represents the window opening.

Formed on the opposite sidewalls of the upper housing section 70 are two groups of vertical slots 72 and 73, respectively, that provide air inlets for the axial flow fan 36. Also on the rearward wall of the upper housing section 70 are vertical slots 74 that provide part of the outlet for air flowing through the condenser heat exchanger 32 and being exhausted into the surrounding atmosphere. The groups of slots 72, 73, and 74 are in vertical alignment with the groups of slots 52, 53, and 54 formed in the lower housing section 50. This can best be seen in FIGS. 1 and 6.

A handle recess 75 is formed in the top of the upper housing section 70 to provide a convenient means for carrying the unit and positioning it during installation.

Formed within the upper housing section 70 are three sets of tracks parallel to one another and to the plane of the window opening. These include a forward track 77, a middle track 78, and a rearward track 79. These tracks 77, 78, and 79 are coplanar with and adapted to cooperate with the tracks 57, 58, and 59 of the lower housing section 50 so as to locate and position the scroll face partition 41, the bulkhead partition 42 and the condenser fan shroud partition 44, respectively. This may be best seen in FIG. 7.

Accordingly, in the operation of the air conditioner 10, air is drawn by the centrifugal blower wheel 37 through inlet grille 24, 25, through the evaporator heat exchanger 33, which is located in the forward portion 21 of the enclosure 20, through the opening 45, and then propelled by centrifugal action in a lateral direction to the left, as viewed in FIG. 2, whereat the bulkhead partition 42 curves to change the flow direction 90 degrees and guide the flow outwardly through the air outlet 28 formed in the grille 23.

Likewise, the flow of air for the condenser heat exchanger 42 includes an initial supply of air through the group of slots 56 in the horizontal floor 51 of the lower housing section 50, and the vertical slots 52, 53, 72, 73 formed in the sidewalls of upper and lower housing sections 70 and 50, in a generally radial direction to the axial flow blower fan 36. The fan 36 then propels the flow of air therethrough in an axial direction to the condenser heat exchanger 32. The air through the condenser heat exchanger 32 is then exhausted through the vertical slots 54 and 74 in the rear walls of the housing sections 50 and 70.

Because of the unique shape of the housing 20 as defined by the upper and lower housing sections 50 and 70, combined with the unique arrangement of the heat exchangers 32 and 33 and the axial flow and centrifugal flow fans 36 and 37 associated therewith, the air conditioning unit 10 provides a significantly improved appearance and functional convenience relative to the prior art. More particularly, the location of the centrifugal blower wheel 37 on the outside of the plane of the window while at the same time the evaporator heat exchanger 33 is located on the inside of the plane of the window opening without any substantial effect on the necessary cross-sectional flow area (while at the same time providing a maximum flow area for the evaporator heat exchanger) results in an exceptionally low profile to minimize the interruption of light being admitted into the room and with minimum obstruction of the view through the window.

It will also be noted that any condensate that collects on the evaporator heat exchanger 33 will drip through channels onto the floor 51 and will be picked up by the rim of the fan 36 and constantly mixed in the air flow to be exhausted in the form of water vapor through the rear of the housing.

The low-profile air conditioner 20 has a novel control module 90 which serves to support the electrical control components and also to provide a control panel on which the manually operable control elements are mounted. The module 90 is best seen in FIGS. 2 and 5.

The module comprises a molded plastic member initially formed in a relatively flat condition with various specially contoured portions to facilitate the mounting of the electrical components. The member has a base portion and a panel portion.

The electrical components are assembled on the base portion and the control elements to include an on/off switch, a fan speed control switch 95 and a temperature control 96 are mounted on the panel portion.

The control module 90 may be inserted in the front housing section 80 just below the air outlet. The front panel is then secured to the front housing section (FIGS. 1 and 5) with the control knobs 95 and 96 in a convenient location.

With the air conditioner construction of the present invention, a minimum number of parts are required to mount the various operative components within the unit. The enclosure 20 has two basic components, namely, the lower housing section 50 and the upper housing section 70. The other necessary components, i.e., partition walls, fan shrouds, etc., are all molded separately.

Also, a minimum number of threaded fasteners are used to secure the upper and lower housing sections together, thus facilitating assembly of the unit.

While the invention has been shown and described with respect to a specific embodiment thereof, this is intended for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A room air conditioner adapted to be sealingly mounted in an opening defied by a window assembly with a vertically sliding lower sash, the opening being defined by the window sill, the bottom rail of the lower sash and the opposed jambs, comprising:

an enclosure having front and rear portions separated by the plane of said opening, said enclosure having a horizontal channel formed therein extending across the top thereof laterally from side to side, said channel separating said front portion from said rear portion and being adapted to receive therein the bottom rail of said lower sash.

a compressor and a condenser heat exchanger mounted in said rear portion, an evaporator heat exchanger mounted in said front portion, a motor drivingly connected to an axial flow fan at one end and to a coaxial centrifugal blower at the other, said axial flow fan and said centrifugal blower having a common horizontal axis perpendicular to the plane of said opening, said motor, axial flow fan and centrifugal blower being located in said rear portion and said axial-flow fan and centrifugal blower being operatively associated with said condenser heat exchanger and said evaporator heat exchanger respectively, said front enclosure portion and said evaporator heat exchanger extending above the bottom of sad lower sash and said rear enclosure portion and said condenser heat exchanger extending above the bottom of said lower sash and substantially below said sill.

2. A room air conditioner as defined in claim 1, including laterally extensible means mounted on said enclosure for sealing the spaces on either side of said enclosure between the sidewalls of the enclosure and the window jambs.

3. A room air conditioner as defined in claim 1, wherein the maximum height of said rear portion is at least 25% greater than the height of said window opening.

4. A room air conditioner as defined in claim 1, wherein said enclosure comprises a lower housing section and an upper housing section adapted to interfit in matching complementary relation with said lower housing section to define an interior space, said sections being formed of molded plastic material with cooperating partitions to define an evaporator flow chamber and a condenser flow chamber therein and supporting means for said blower motor and said heat exchangers.

5. A room air conditioner as defined in claim 4, wherein said housing sections cooperate to form a forwardly extending hand grip at the forward end thereof.

6. A room air conditioner as defined in claim 1, further including a pair of adjustable leveling arms, each being pivotally connected to a respective sidewall of said enclosure just above said window sill and adapted to pivot about a pivot axis at its inner end between a retracted position above the plane of said window sill and a downwardly extended position in engagement with the sloping outer portion of said sill, and means for securing each of said arms relative to the respective enclosure sidewall in its downwardly extended position.

7. A room air conditioner as defined in claim 6, wherein said securing means comprises a plurality of radial teeth formed on each respective sidewall of said enclosure in an arcuate pattern centered at said pivot axis, corresponding radial teeth formed on the inner surface of the respective leveling arm and adapted for locking engagement with said radial teeth on the adjacent sidewall and means for releasable clamping said leveling arm against said sidewall in a preselected supporting position to engage said opposed teeth to lock said arm against pivotal movement relative to said housing.

8. A room air conditioner as defined in claim 7, wherein said securing means comprises a threaded fastener.

9. A room air conditioner adapted to be sealingly mounted in an opening defined by a window assembly with a vertically sliding lower sash, the opening being defined by the window sill, the bottom rail of the lower sash and the opposed jambs, comprising:

an enclosure having front and rear portions separated by the plane of said opening, a compressor and a condenser heat exchanger mounted in said rear portion, an evaporator heat exchanger mounted in said front portion, a motor drivingly connected to an axial-flow fan at one end and a coaxial centrifugal blower at the other end, said motor, axial-flow fan and centrifugal blower being located in said rear portion and said axial-flow fan and centrifugal blower being operatively associated with said condenser heat exchanger and said evaporator heat exchanger, respectively, said front enclosure portion and said evaporator heat exchanger extending above the bottom of said lower ash and said rear enclosure portion and said condenser heat exchanger extending above the bottom of said lower sash and substantially below said sill, a pair of adjustable leveling arms, each being pivotally connected to a respective sidewall of said enclosure just above said window sill and adapted to pivot about a pivot axis at its inner end between a retracted position above the plane of said window sill and a downwardly extended position in engagement with the sloping outer portion of said sill, a plurality of radial teeth formed on each respective sidewall of said enclosure in an arcuate pattern centered at said pivot axis, corresponding radial teeth formed on the inner surface of the respective leveling arm and adapted for locking engagement with said radial teeth on the adjacent sidewall and means for releasably clamping said leveling arm against said sidewall in a preselected supporting position to engage said opposed teeth to lock said arm against pivotal movement relative to said housing.

10. A room air conditioner as defined in claim 9, wherein said securing means comprises a threaded fastener.

* * * * *

UNITED STATES PATENT AND TRADEMARK OFFICE

CERTIFICATE OF CORRECTION

PATENT NO. : 5,253,485

DATED : October 19, 1993

INVENTOR(S) : Robert W. Kennedy et al

It is certified that error appears in the above-indentified patent and that said Letters Patent is hereby corrected as shown below:

Column 5, line 54, after "opening" insert --11--.
Column 6, line 56, after "opening" insert --11--.
Column 7, Claim 1, line 46, delete "defied" and insert --defined--.
Column 8, Claim 1, line 4, delete "sad" and insert --said--.
Column 8, Claim 7, line 47, delete "releasable" and insert --releasably--.
Column 9, Claim 9, line 8, delete "ash" and insert --sash--.

Signed and Sealed this

Tenth Day of May, 1994

Bruce Lehman

*Attest:*

BRUCE LEHMAN

*Attesting Officer*

*Commissioner of Patents and Trademarks*